United States Patent [19]

Kyle

[11] 4,188,771

[45] Feb. 19, 1980

[54] MEAT PACKAGING MACHINE

[75] Inventor: Rhoden R. Kyle, Mississauga, Canada

[73] Assignee: C.A. Pemberton & Co. Limited, Toronto, Canada

[21] Appl. No.: 880,187

[22] Filed: Feb. 22, 1978

[51] Int. Cl.[2] ..... B65B 31/02

[52] U.S. Cl. ..... 53/511

[58] Field of Search ..... 53/112 A, 112 R, 510, 53/511

[56] References Cited

U.S. PATENT DOCUMENTS

| | | | |
|---|---|---|---|
| 3,673,760 | 7/1972 | Canamero et al. | 53/112 A X |
| 3,706,174 | 12/1972 | Young et al. | 53/112 A |
| 3,750,362 | 8/1973 | Kishpaugh et al. | 53/112 A X |
| 3,992,850 | 11/1976 | Vetter | 53/112 A X |

*Primary Examiner*—Travis S. McGehee

*Attorney, Agent, or Firm*—Fetherstonhaugh & Co.

[57] ABSTRACT

The meat packaging machine of the present invention is designed to vacuum pack meat products between two webs of heat sealable thermo-plastic material. One web of each package is formed with at least two pockets connected by and bounded by a sealing flange extending outwardly therefrom. The second web which closes the pockets also extends over the sealing flange and the entire interface between the two webs is heat sealed to prevent migration of meat juices. The machine includes a sealing head and a sealing die mounted one on either side of the sealing plane. Heated sealing members are located in the sealing head and in the sealing die which, when the head and die are in the closed position, are disposed to engage the first and second webs therebetween to effect a heat seal over the entire sealing interface of the webs.

3 Claims, 6 Drawing Figures

MEAT PACKAGING MACHINE

FIELD OF INVENTION

This invention relates to improvements in meat packaging machines. In particular, this invention relates to improvements in a meat packaging machine of the type in which meat products are vacuum packed between two webs of heat sealable thermoplastic material.

PRIOR ART

Meat products have been vacuum packaged between two webs of thermo-plastic material for some considerable time. It is common practice to form packages in which a plurality of meat products are located in pockets which are formed in one web and which are bounded and spaced from one another by flanges which extend about the periphery of each pocket. In these known packages the top and bottom webs are sealed to one another about the peripheral edge of the package so that a vacuum is maintained within the package and leakage from the package as a whole is prevented. The seal does not, however, extend over the entire width of the flanges extending around and between adjacent pockets, with the result that it is possible for meat juices to migrate from one pocket across the unsealed interface between pockets and towards the peripheral edge seal. This creates a package which does not have eye appeal to the consumer. Furthermore, if any part of the web located inwardly from the sealed peripheral edge is punctured or otherwise damaged, the vacuum in the entire package will be lost so that the entire contents of the package may spoil. In the industry, the term "leakers" is used to describe packages in which a sealing problem has developed and such is the nature of this packaging process that "leakers" are common. One of the features of this form of meat packaging is that it enables the meat to be stored for a substantial period of time. However, the longer the storage period and the more handling the packages are subjected to, the greater the chance of "leakers" being formed and migration of juices into the flange areas.

U.S. Pat. No. 3,956,867, dated May 16, 1976, Utz et al, describes one method of forming a vacuum packed meat package. This patent includes a diagrammatic representation of a method and apparatus for forming pockets "one up" in a web. In the heat sealing station, a seal line is formed about the periphery of each package. In this instance, because each package has only one pocket, the seal line extends around the single pocket which is located in the sealing station. If, however, a plurality of pockets remains connected so that a package having several pockets is formed, a substantial portion of the web between each successive pocket will be unsealed so that any interruption in the seal line about the periphery of any one pocket would permit migration of juices into the unsealed areas between the webs.

The primary object of the heater units in Utz is to heat the heating chamber so that the web will be heated and will shrink into close conformity with the meat product. In the development of the apparatus of the present invention, it has been found that heating of the entire heating chamber and the provision of a heater extending across the full width of the head so as to be directed towards the head can result in a heating of the product to an extent sufficient to cause discolouration of the product, with the result that the meat products such as red meat lose their red colour and thereby lose a substantial portion of their eye appeal.

It is an object of the present invention to seal the two webs which go together to form the package over the entire interface formed between the webs to prevent migration of heat juices from the pockets and to reduce the area of the package which may be punctured to create "leakers".

SUMMARY OF INVENTION

According to one aspect of the present invention, there is provided in a meat packaging machine in which meat products are vacuum packed between first and second webs of heat sealable thermo-plastic material which are driven along a sealing plane which extends through a sealing station, the first web being formed to provide a plurality of pockets, at least two pockets to each package, the pockets being bounded and spaced from one another by a unitary sealing flange and, in said sealing station, the second web extending across the first web so that first portions thereof are disposed in a face-to-face relationship with and are coextensive with said sealing flange of said first web so that the first and second webs may be moved towards one another to form a continuous sealing interface between said first portions of said web and said sealing flange, said second web also having end closure portions extending across and closing the upper ends of each pocket located in said sealing station, the improvement of: a sealing head and a sealing die mounted one on either side of said sealing plane for movement relative to one another between an open position to admit webs to said sealing station and a closed position for evacuating and sealing said packages, heated sealing means in said sealing die and in said sealing head which, when said head and die are in said closed position, are disposed to engage said first portion of said second web and said sealing flange of said first web respectively to heat seal said webs together over the entire sealing interface and thereby prevent migration of meat juices from each pocket and reduce the area of the package which may be punctured to produce leakers.

PREFERRED EMBODIMENT

The invention will be more clearly understood after reference to the following detailed specification read in conjunction with the drawings, wherein FIG. 1 is a diagrammatic representation of a meat packaging machine according to one aspect of the present invention;

Figure 1:
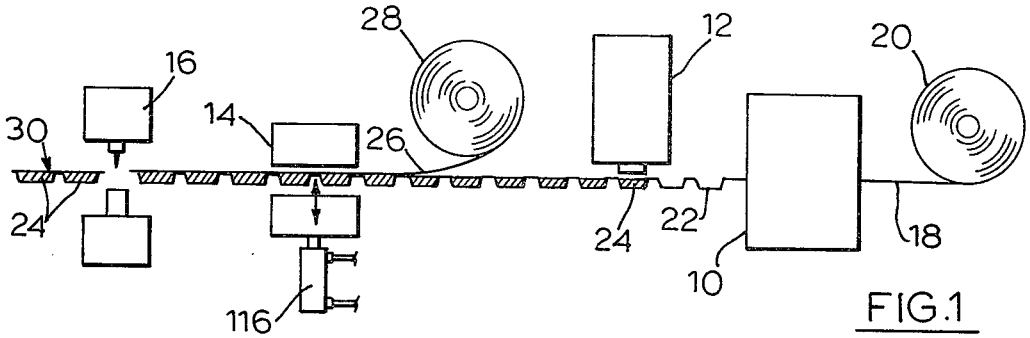

As previously indicated, apparatus of the general type to which the present invention relates is well known and consists of a pocket forming apparatus 10, a filler unit 12, sealer unit 14 and cutter unit 16. A first web 18 of thermo-plastic material is unwound from a coil 20 and directed through the pocket former 10 wherein a plurality of pockets 22 are formed. The filler unit 12 deposits meat products 24, one at each pocket 22. A second web 26 is unwound from a coil 28 and extends across the open upper ends of the pockets 22 and the adjacent peripheral edges thereof. The thus laminated webs enter the sealer 14 in which they are sealed together, as will be described hereinafter, and are discharged from the sealer to cutter 16 in which the webs are severed to form individual packages 30, each containing a plurality of meat products 24 located in spaced apart pockets 22.

Figure 2:
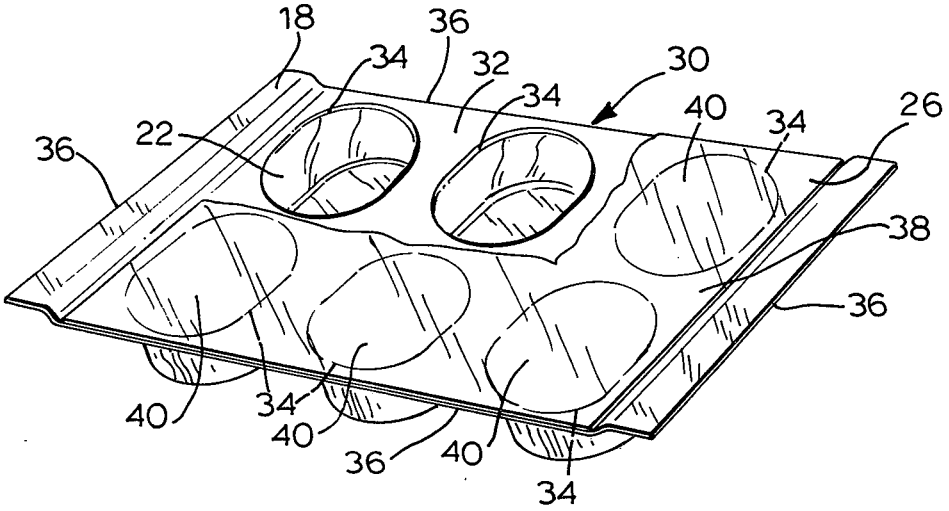
FIG. 2 is a pictorial view of a loaded meat package constructed in accordance with an embodiment of the present invention.

With reference to FIG. 2 of the drawings, it will be seen that the first web 18 of the package 30 is formed so that the pockets 22 are bounded by and spaced from one another by a unitary sealing flange 32 which in this preferred embodiment is planar. The sealing flange 32 extends continuously between the peripheral edges 34 of the pockets 22 and the peripheral edges 36 of each first web 18.

The second web 26 is narrower than the first web 18 to facilitate evacuation of the package in use as will be described hereinafter. The second web 26 includes a first portion 38 disposed in a face-to-face relationship with the sealing face of the sealing flange 32 of the first web 18 and second portions 40 extending across the pockets 22 between the peripheral edges 34 thereof to close the pockets 22. It will be noted that the entire interface formed between the sealing flange 32 and the first portion of the second web 26 is heat sealed. As a result, a seal is formed about the peripheral edge 34 of each pocket which extends over the entire interface between the first and second webs so that meat juices cannot migrate from any one of the pockets. In addition, it will be noted that if any portion of the laminated webs are punctured outwardly from the peripheral edge 34 of each pockets, the puncture will not create a "leaker" nor will it destroy the vacuum. Furthermore, if any one web is punctured so that the puncture opens into any one of the pockets 22, this will not adversely affect the vacuum packaging of meat in the other pockets as the pockets are sealed individually by the forming of a heat sealed bond over the entire sealing interface. By forming a sealing bond extending over the entire interface between the two webs, the migration problems commonly experienced in previous packages have been eliminated and the likelihood of leakers resulting from puncturing of the package has been greatly reduced.

Figure 3:
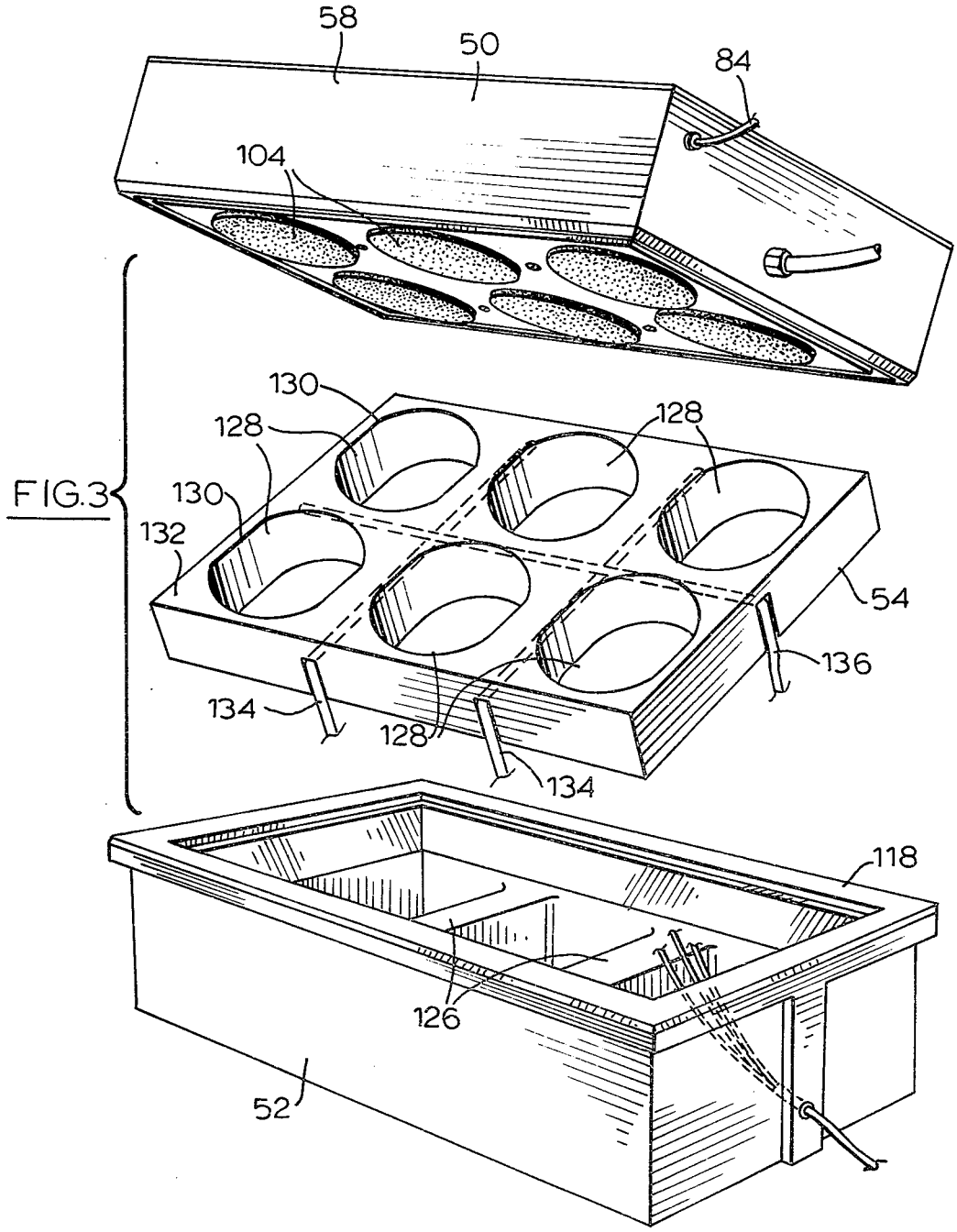
FIG. 3 is an exploded view of a sealer unit according to one aspect of the present invention.

With reference to FIG. 3 of the drawings, it will be seen that the sealer unit 14 comprises a sealing head 50, a die box 52 and a sealing insert 54.

Figure 4:
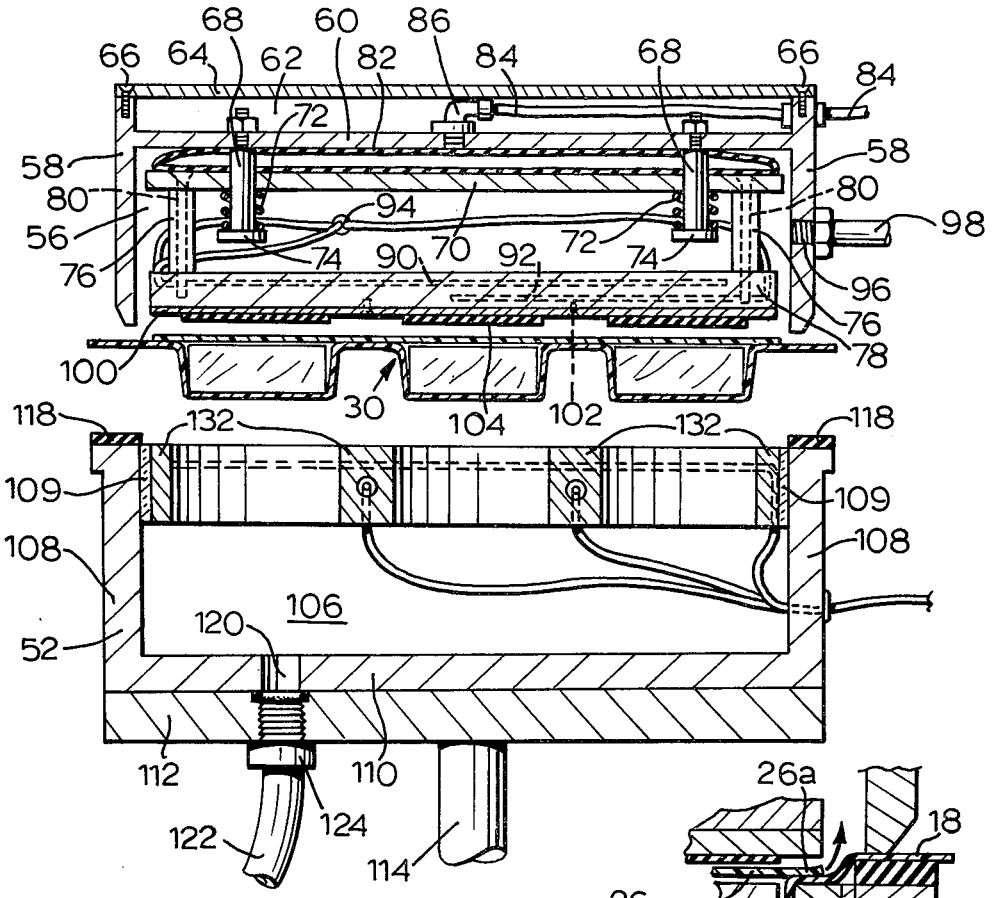
FIG. 4 is a cross-sectional view of an assembled sealer unit in an open position.

With reference to FIGS. 3 and 4 of the drawings, it will be seen that the sealing head 50 is formed with a vacuum chamber 56 bounded by side walls 58 and a top wall 60. A recess 62 is formed above the top wall 60 and a top plate 64 extends across the upper end of the head 50 to close the recess 62 and is secured by mounting screws 66 to the upper edge of the side walls 58. Guide posts 68 are mounted at spaced intervals on the top wall 60 of the vacuum chamber 56 and project downwardly therefrom. A support plate 70 is slidably mounted on the guide posts 68 and coil springs 72 extend between the plate 70 and the head 74 of each guide post 68. Support posts 76 are mounted on the plate 70 and project downwardly therefrom. A sealing platen 78 is located at the lower end of support post 76 and is secured with respect to the support post 76 and support plate 70 by mounting screws 80. An inflatable bladder 82 is located in the vacuum chamber between the top wall 60 thereof and the support plate 70. The bladder 82 has an inlet passage communicating with conduit 84 through an elbow connection 86. The conduit 84 extends outwardly from the head and is connected to a source of compressed air in a manner so that air may be supplied through the conduit 84 to inflate the bladder 82 and to permit deflation of the bladder 82 as required. When the bladder 82 is inflated, the sealing platen is moved outwardly of the vacuum chamber and the compression springs 72 are compressed. When the air pressure in the bladder 82 is released, the springs 72 reassert themselves to return the sealing platen to the raised position shown in FIG. 4. Electrical heating elements 90 are embedded in the sealing platen 78 and communicate with a source of electricity through lead lines which extend outwardly from the head through passage 94. Temperature sensing elements 92 are also embedded in the sealing platen for use in monitoring the temperature of the sealing platen.

A vacuum passage 96 opens through the wall 58 of the vacuum chamber and communicates with the source of vacuum through conduit 98.

A face plate 100 is detachably mounted on the lower face of the sealing platen 78 by means of mounting screws 102. The face plate 100 is made from heat conductive material, such as steel or the like. A plurality of heat insulating pads 104 are mounted on the face plate 100. The pads 104 are contoured and proportioned so as to have the same shape and size as the second portions 40 of the second web 26 (FIG. 2). One insulating pad 104 is provided for each pocket of the package and arranged on the face plate so as to be disposed above a pocket of the package in use as will be described hereinafter.

The die box 52 has a vacuum chamber 106 formed therein which is bounded by side walls 108 and bottom wall 110. The bottom wall 110 is mounted on a platform 112 which is supported by a shaft 114 of a double-acting pneumatic cylinder 116 (FIG. 1). The pneumatic cylinder 116 is operable to reciprocally drive the shaft 114 to raise and lower the platform 112 and its associated die box 52 as required in use. A resilient gasket 118 is mounted at and extends about the upper edge of the side walls 108 of the box 52. The vacuum is drawn in the vacuum chamber 106 through a passage 120 formed in the bottom wall 110 which communicates with a conduit 122 by way of coupling 124 which extends through the platform 112.

With reference to FIG. 3 of the drawings, it will be seen that the die box 52 may be strengthened by reinforcing ribs 126 which extend transversely thereof a substantial distance below the upper edge of the vacuum chamber. The ribs 126 also serve to support the sealing station insert 54. The sealing station insert 54 (FIGS. 3 and 4) consists of a unitary block of heat conducting material such as aluminum formed with a plurality of apertures 128 which open therethrough. In this embodiment, six apertures are provided as there are six pockets in each package. The apertures 128 are proportioned to receive a pocket 22 in a close fitting relationship so that the upper peripheral edge 130 of each passage 128 may be located closely adjacent the peripheral edge 34 (FIG. 2) of each pocket of the first web 18. In practice, the clearance between the outer side wall of each package and the inner face of each aperture 128 is preferably no more than 3/16ths of an inch, regardless of the proportions of the pocket. The sealing insert 54 has an upper sealing surface 132. It is desirable to minimize the clearance between the pockets of the web and the side walls of the apertures 128 so as to maximize the size of the upper sealing surface 132. Heating elements 134 and temperature monitoring elements 136 are embedded in the sealing insert 54 and are connected through lead lines 134*a* and 136*a* to a source of electrical energy and a temperature monitoring station respectively. Preferably, the heating elements 134 are located so as to ensure that the entire sealing surface 132 may be heated rapidly to a heat sealing temperature sufficient to provide a rapid heat seal at the interface of the webs in use.

The sealing insert 54 is located in the die box resting on support ribs 126 with the sealing surface 132 upwardly directed. A heat insulating liner 109 is located about the periphery of the sealing insert 54 to minimize heat conduction from the sealing insert 54 to the die box.

It will be understood that the sealing insert 54 which is illustrated in the preferred embodiment may be replaced by another sealing insert having apertures of a different contour and of a different total number, depending upon the number and form of meat product which is to be packaged. Similarly, the face plate 100 with its associated heat insulating pads 104 may be replaced by an alternative face plate with insulating pads shaped and arranged to match the apertures of an alternative sealing insert.

Figure 5:
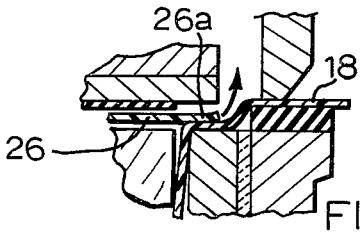
FIG. 5 is an enlarged detailed view of one edge of the sealer unit illustrating the manner in which a vacuum is drawn in the package.
Figure 6:
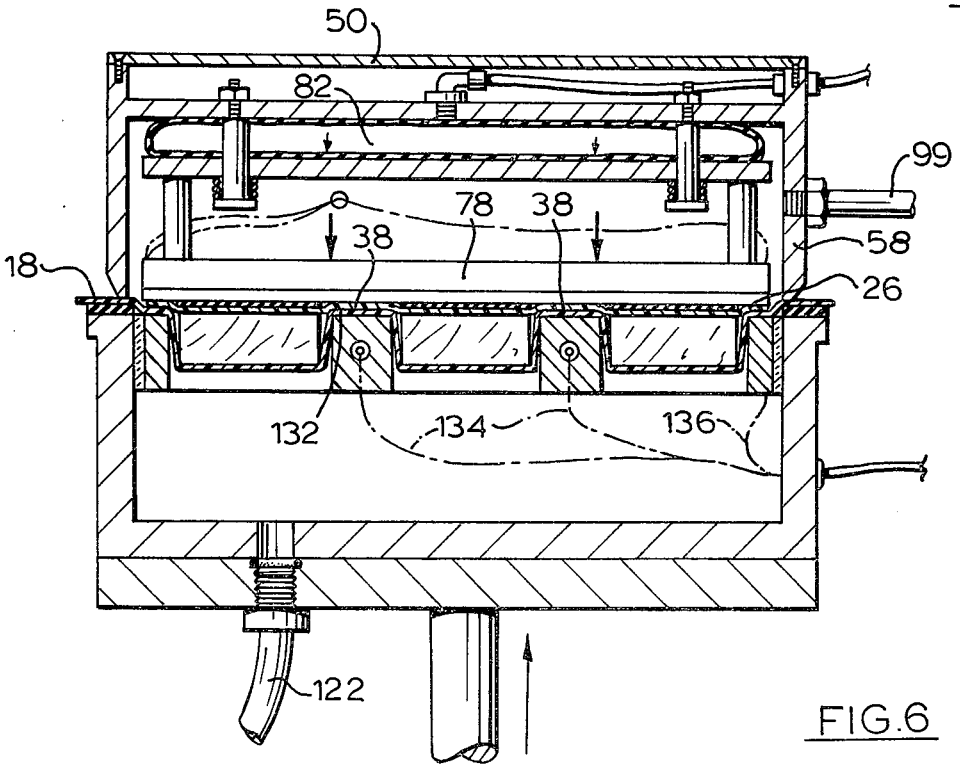
FIG. 6 is a cross-sectional view of a sealer unit of FIG. 4 located in the closed sealing position.

In use, the appropriate sealing insert and face plate set is selected for the product which is to be packaged. The selected face plate and insert are mounted on the head and die box respectively in the manner previously described. The required sealing temperature is established and the platen and sealing insert are heated to the required temperature. The loaded webs are fed to the sealing device, as illustrated in FIG. 1 of the drawings, when the die box 52 is in the lowered position shown in FIG. 4 of the drawings. The pneumatic cylinder 116 is then activated to raise the die box 52 to place the sealing surface 132 of the sealing insert 54 in contact with the lower surface of the sealing flange 32 of the first web 18 as shown in FIG. 6. The die box 52 is elevated until upward movement is prevented by the lower edge of the side walls 58 of the head 50 (FIG. 6). The marginal edge portions of the first web 18 which project outwardly beyond the side edges of the second web 26 are clamped between the lower edge of the side wall 58 of the head and the resilient gasket 118 so that the vacuum chambers formed in both the head and the die box are sealed. Thereupon, the vacuum is drawn in both vacuum chambers through the conduits 99 and 122 respectively. As shown in FIG. 5 of the drawings, the marginal edge portion 26*a* of the web 26 is not held down and will, therefore, rise up when a vacuum is applied to the vacuum chamber of the head so that air may be withdrawn from each of the pockets. After evacuation of air from both vacuum chambers, air is supplied under pressure to the bladder 82. The expansion of the bladder 82 causes the platen 78 to be driven towards the insert 54 so that the entire sealing face 32 of the lower or first web 18 is placed in contact with the first portions 38 of the second web 26 and are retained in this position until the entire interface is bonded by heat sealing at the interface.

After sealing has been completed, the sealing device is opened by a reversal of the steps described above in obtaining closure thereof.

The apparatus of the present invention is simple and inexpensive to manufacture and it permits the rapid re-fitting of the sealing device for use in the sealing of packages of different shape and configuration.

It will be apparent from the foregoing description of the preferred embodiment that the present apparatus provides a total seal about the entire periphery of each product which will prevent migration of meat juices and which will serve to minimize leakers resulting from puncturing of the web.

Various modifications of the apparatus of the present invention will be apparent to those skilled in the art without departing from the scope of the invention. For example, the inflatable bladder structure used for moving the sealing platen may be replaced by a mechanical drive mechanism or a hydraulic mechanism.

What I claim as my invention is:

1. In a meat packaging machine in which meat products are vacuum packed between first and second webs of heat sealable thermo-plastic material which are driven along a sealing plane which extends through a sealing station, the first web being formed to provide a plurality of pockets, at least two pockets to each package, the pockets being bounded and spaced from one another by a unitary sealing flange and, in said sealing station, the second web extending across the first web so that first portions thereof are disposed in a face-to-face relationship with and are coextensive with said sealing flange of said first web so that the first and second webs may be moved towards one another to form a continuous sealing interface between said first portions of said web and said sealing flange, said second web also having end closure portions extending across and closing the upper ends of each pocket located in said sealing station, the improvement of a sealing station comprising;

(a) a sealing head disposed on one side of said sealing plane having a vacuum chamber formed therein which opens toward said sealing plane, a sealing platen mounted in said vacuum chamber, said sealing platen having a sealing face directed toward said sealing plane, (b) a sealing die base disposed on the other side of said sealing plane directly opposite said sealing head, said base having a vacuum chamber opening outwardly therefrom toward said sealing plane, (c) a sealing insert adapted to fit within the open end of said vacuum chamber, said insert having a planar sealing surface directed outwardly from said vacuum chamber toward said sealing plane, a plurality of contoured apertures opening through said sealing insert from said planar sealing surface, said apertures being contoured and proportioned to extend around the side of the preformed pockets of the first web in a closely spaced relationship therewith whereby said sealing surface may extend closely adjacent to the periphery of the meat product, (d) heat insulating means mounted on said sealing face of said sealing platen directly opposite each sealing aperture of said sealing insert to prevent heating of the meat products to an extent sufficient to cause discolouration, (e) heater means in said sealing insert and in said sealing head, said heater means being operable to heat substantially the entire planar heat sealing surfaces of said head and substantially the entire planar heat sealing surface of said sealing insert to a temperature sufficient to effect a rapid heat seal over the entire sealing interface of the webs located therebetween in use, (f) means for effecting relative movement between the sealing die and sealing head to move them between an open position for admitting webs to said sealing station and discharging webs from sealing station and a closed position in which the first and second webs are clamped between said heat sealing surfaces of said head and said sealing insert to permit simultaneous heat sealing of the entire sealing interface.

2. In a meat packaging machine in which meat products are vacuum packed between first and second webs of heat sealable thermo-plastic material which are driven along a sealing plane which extends through a sealing station, the first web being formed to provide a plurality of pockets, at least two pockets to each package, the pockets being bounded and spaced from one another by a unitary sealing flange and, in said sealing station, the second web extending across the first web so that first portions thereof are disposed in a face-to-face relationship with and are coextensive with said sealing flange of said first web so that the first and second webs may be moved towards one another to form a continuous sealing interface between said first portions of said web and said sealing flange, said second web also having end closure portions extending across and closing the upper ends of each pocket located in said sealing station, the improvement of a sealing station comprising;

(a) a sealing head disposed on one side of said sealing plane having a vacuum chamber formed therein which opens toward said sealing plane, a sealing platen mounted in said vacuum chamber, said sealing platen having a sealing face directed toward said sealing plane, (b) a sealing die base disposed on the other side of said sealing plane directly opposite said sealing head, said base having a vacuum chamber opening outwardly therefrom toward said sealing plane, (c) a sealing insert adapted to fit within the open end of said vacuum chamber, said insert having a planar sealing surface directed outwardly from said vacuum chamber toward said sealing plane, a plurality of contoured apertures opening through said sealing insert from said planar sealing surface, said apertures being contoured and proportioned to extend around the side of the preformed pockets of the first web in a closely spaced relationship therewith whereby said sealing surface may extend closely adjacent to the periphery of the meat product, (d) heater means in said sealing insert and in said sealing head, said heater means being operable to heat substantially the entire sealing face of said head and substantially the entire planar heat sealing surface of said sealing insert to a temperature sufficient to effect a rapid heat seal over the entire sealing interface of the webs located therebetween in use, (e) means for effecting relative movement between the sealing die and sealing head to move them between an open position for admitting webs to said sealing station and discharging webs from sealing station and a closed position in which the first and second webs are clamped between said heat sealing surfaces of said head and said sealing insert to permit simultaneous heat sealing of the entire sealing interface.

3. In a meat packaging machine in which meat products are vacuum packed between first and second webs of heat sealable thermo-plastic material which are driven along a sealing plane which extends through a sealing station, the first web being formed to provide a plurality of pockets, at least two pockets to each package, the pockets being bounded and spaced from one another by a unitary sealing flange and, in said sealing station, the second web extending across the first web so that first portions thereof are disposed in a face-to-face relationship with and are coextensive with said sealing flange of said first web so that the first and second webs may be moved towards one another to form a continuous sealing interface between said first portions of said web and said sealing flange, said second web also having end closure portions extending across and closing the upper ends of each pocket located in said sealing station, the improvement of a sealing station comprising;

(a) a sealing head disposed on one side of said sealing plane having a vacuum chamber formed therein which opens toward said sealing plane, a sealing platen mounted in said vacuum chamber, said sealing platen having a sealing face directed toward said sealing plane, (b) a sealing die base disposed on the other side of said sealing plane directly opposite said sealing head, said base having a vacuum chamber opening outwardly therefrom toward said sealing plane and a planar sealing surface directed outwardly from said vacuum chamber toward said sealing plane, a plurality of contoured apertures opening inwardly from said planar sealing surface, said apertures being contoured and proportioned to extend around the side of the preformed pockets of the first web in a closely spaced relationship therewith whereby said sealing surface may extend closely adjacent to the periphery of the meat product, (c) heater means in said sealing die base and in said sealing head, said heater means being operable to heat substantially the entire sealing face of said head and substantially the entire planar heat sealing surface of said sealing die base to a temperature sufficient to effect a rapid heat seal over the entire sealing interface of the webs located therebetween in use, (d) said planar sealing surface of said sealing die extending continuously from one aperture to the other and to the perimeter of said planar sealing surface, said sealing face of said sealing platen being co-extensive with said sealing surface of said die base thereby to form a sealing interface extending continuously between adjacent apertures and the perimeter of the planar sealing surface of the base, (e) means for effecting relative movement between the sealing die base and sealing head to move them between an open position for admitting and discharging webs to and from sealing station and a closed position in which the first and second webs are clamped between said heat sealing surfaces of said head and said sealing die base to permit simultaneous heat sealing of the entire sealing interface.

* * * * *